United States Patent [19]

Kunita et al.

[11] 4,343,469

[45] Aug. 10, 1982

[54] GOLF GAME PRACTICING APPARATUS

[75] Inventors: Yoshisuke Kunita; Yoshikatsu Ishida; Masaharu Kuwabara, all of Hamamatsu, Japan

[73] Assignee: Nippon Gakki Seizo Kabushiki Kaisha, Hamamatsu, Japan

[21] Appl. No.: 147,296

[22] Filed: May 6, 1980

[30] Foreign Application Priority Data

May 7, 1979 [JP] Japan ..... 54-55567

[51] Int. Cl.[2] ..... A63B 69/36; A63F 9/22

[52] U.S. Cl. ..... 273/185 A; 273/85 G; 273/181 G; 273/186 C; 273/DIG. 28; 273/118 A

[58] Field of Search ..... 273/176 FA, 176 L, 177 R, 273/181 G, 181 H, 183 R, 184 R, 185 B, 371, 372, 374, DIG. 28, 85 G, 87 R, 118 A; 434/252; 364/410, 200 MS File, 900 MS File

[56] References Cited

U.S. PATENT DOCUMENTS

| | | | |
|---|---|---|---|
| 3,469,905 | 9/1969 | Baldwin et al. . | |
| 3,501,152 | 5/1970 | Conklin et al. . | |
| 3,513,707 | 5/1970 | Russell et al. . | |
| 3,591,184 | 7/1971 | Conklin | 273/176 FA |
| 3,643,959 | 2/1972 | Cornell et al. | 273/176 FA |
| 3,658,343 | 4/1972 | Rogers et al. . | |
| 3,712,624 | 1/1973 | Conklin | 273/176 FA |
| 3,857,022 | 12/1974 | Rebane et al. | 273/372 |
| 4,086,630 | 4/1978 | Speiser et al. | 273/176 L |
| 4,136,387 | 1/1979 | Sullivan et al. | 273/185 R X |
| 4,177,994 | 12/1979 | Lindquist | 273/176 FA |
| 4,192,510 | 3/1980 | Miller | 273/176 A |

*Primary Examiner*—Vance Y. Hum

*Attorney, Agent, or Firm*—Cushman, Darby & Cushman

[57] ABSTRACT

A golf game practicing apparatus capable of simulating putting shots on a putting green comprises: a memory section for storing data concerning the distribution of heights of the curved surface of the green; a device for displaying the image of this curved surface on a display screen based on the stored data; ball information detecting section for detecting the velocity vector of a rolling ball struck by a player at a designated putt position toward a hole in the green depicted on the screen; and a computer for computing an imaginary trajectory of the ball rolling on the depicted green based on the detected velocity vector and the curved surface data. The ball trajectory is depicted on the display screen in accordance with the result of the computation.

25 Claims, 9 Drawing Figures

GOLF GAME PRACTICING APPARATUS

BACKGROUND OF THE INVENTION (a) Field of the Invention

The present invention relates generally to a golf game practicing apparatus, and more particularly it pertains to a golf game apparatus including a simulating device for simulating, on a display screen, the trajectory and the position of a ball struck on a putting green.

(b) Description of the Prior Art

As a golf game practicing machine, especially as an indoor golf game practicing machine, there is known, for example, the Indoor Golf Game Apparatus disclosed in Japanese Patent Publication No. Sho. 47-256 (corresponding to U.S. Pat. Nos. 3,469,905, 3,501,152 and 3,513,707). This known apparatus is a sort of simulating device, which is arranged so that, as the golf player strikes a ball (either iron shot or wood shot) toward a golf course which is depicted on a screen by a slide projector, the velocity vector of the ball thus struck is detected, and that on the basis of the result of the detection, the distance of the flight of the ball is computed, and that in accordance with the result of this computation, the scene of the terrain of the golf course which is depicted on the screen changes to a scene closer to the green in accordance with the advancement of the ball, and that this pattern on the indication of the scene of the terrain changes successively as the ball is advanced in succession. In this known apparatus, however, putting of the ball no longer requires the assistance by this apparatus, but rather it is performed by actually putting the ball on a putting mat which may be either flat or curved surface provided on a part of the apparatus, based on the interpretation that the imaginary ball has advanced successfuly onto the green.

On the other hand, as a putting practicing machine, there have been made various proposals, including Japanese Patent Publication No. Sho 49-4490 (corresponding to U.S. Pat. No. 3,658,343) which provides for a practicing terrain of green having a curved surface which can be changed from one curved pattern to another as required, or Japanese Utility Model Publication No. Sho 51-15575 which proposes a golf practicing machine having an automatic ball feeding means, means for indicating the number of shots and means for indicating the number of hole-outs, and Japanese Utility Model Publication No. Sho 51-36604 which teaches the arrangement for indicating the scores in accordance with each position assumed by the ball struck toward the target. In each of these prior art practicing machines, putting is performed under the condition considerably different from the putting done on an actual green, i.e. on these known practicing machines, the firmness of the turf is set as being constant, and the directions of the leaves of the turf are set to be constant, and also the surface configuration of the green is ordinarily set as being constant, and moreover there are other problems such that these known practicing machines require a large space or area and that it is hardly possible to practice long putts for a distance such as 10 meters.

SUMMARY OF THE INVENTION

It is, therefore, a primary object of the present invention to provide a golf game practicing apparatus capable of simulating the trajectory of a ball during putts, which is arranged so that the movements of the trajectory of the ball toward the target is displayed on a screen to be visualized by the player to enable the player to practice putting in a way close to actual performance on a green.

Another object of the present invention is to provide an apparatus of the type described above, which is capable of giving the player of putting a sense as if he is practicing on a real green, by the arrangement that the image of the terrain of the green displayed on the screen changes for each approach of the ball toward the target to depict a terrain of the green closer to the target than the image before the termination of the preceding putt.

Still another object of the present invention is to provide an apparatus of the type described above, arranged so that the sequential number of putts performed is indicated on the screen.

A further object of the present invention is to provide an apparatus of the type described above, which enables the player to change the putting course on a same single green.

BRIEF DESCRIPTION OF THE DRAWINGS

FIGS. 4A and 4B are diagrams for explaining axes of co-ordinates of data concerning the curved surface of the green which are stored in a data memory section of the device in FIG. 2, in which:

FIG. 4A is an explanatory illustration of the plan view of the green, and

FIG. 4B is an explanatory illustration of a vertical section of the green.

FIGS. 7A and 7B are diagrams for explaining the operation of a mapping transforming section in the device of FIG. 2, in which:

FIG. 7A is a diagram for explaining the principle of transforming the mapping image, and FIG. 7B is a diagram for explaining the positional relationship between the player and the green in an actual golf course.

DETAILED DESCRIPTION OF THE PREFERRED EMBODIMENT

Figure 1:
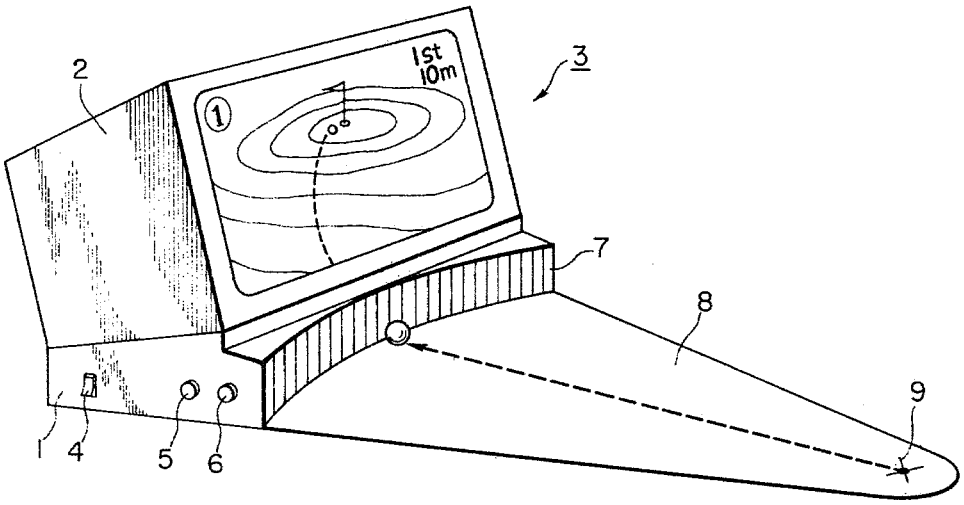
FIG. 1 is a perspective view of a putt-practicing apparatus embodying the present invention.

Description will hereunder be made of the present invention with respect to a preferred embodiment by referring to the accompanying drawings. FIG. 1 is a perspective view of a putt-practicing apparatus 3 comprising a simulating device 1 according to the present invention, and a television receiver 2 serving as a display means mounted on said simulating device in a backwardly inclined position to facilitate easy visualization by the player. This simulating device 1 is provided, on one side thereof, with a power-supply switch 4, a reset button 5 and a putt course setting button 6, and, on the front side thereof, with a ball detecting section 7, and further with a putting mat 8 of about 1.5 m in length extending from the ball detecting section 7. An X mark 9 for designating the putting position is provided on an end portion of this putting mat 8 located away from said ball detecting section 7.

This putt-practicing apparatus 3 is used in such manner as described below. As a first step, the power-supply switch 4 is energized. Whereupon, the curved surface of the green with contour lines is depicted on the television screen of the receiver 2. At the same time, the sequential number of putts "1st" and a distance "10 m" toward the target are depicted on the upper right portion of the screen. Similarly, a putting course number "①" is indicated on the upper left portion of the screen. The sequential number of putts "1st" represents a "first putt". The distance "10 m" signifies the distance from the designated putting position, i.e. the position at the mark X at reference numeral 9, to the target, i.e. the hole. The number "1" of the putting course shows one of the numbers which are predetermined for a plurality of the putting courses on a same single green. Then, the player places the ball, such as a golf ball, on the mark 9, and hits this ball toward the target depicted on the display screen. Whereupon, the ball thus struck will hit the ball detecting section 7 and will stop therearound. The velocity vector, i.e. the speed and the direction of the rolling ball, at the moment this ball hits the ball detection section 7 is detected by this section 7, and the assumed trajectory of the ball after it was struck by the player, i.e. after the ball hits the detecting section 7, is computed within the simulating device 1. As a result of this computation, the trajectory of the ball rolling on the green which is depicted on the television screen is indicated in terms of real time. For such part of operation, arrangement is provided so that the size of the ball will become progressively smaller with an increase in the distance between the player and the ball. When the ball depicted on the screen comes to a halt, the image which has till then been depicted on the screen will, after several seconds from the moment of the halt of the ball, automatically alter to an image representing the target as viewed from the position at which the ball came to a halt. Concurrently therewith, the sequential number "1st" which has been depicted on the upper right portion of the screen alters to "2nd" indicating the second putt to be made, and the indication of the distance "10 m" alters to the distance from the position of halt of the ball to the target. However, the number "①" indicating the putting course will not change. That is, this number "①" of the putting course will remain unchanged until the ball enters into the cup of the goal. Then, the player will again place a ball on the mark X at 9, and strikes this ball toward the target. Whereupon, in exactly the same manner as described above, the trajectory of the rolling ball is depicted on the television screen. In case, however, the ball has failed to enter into the hole, the image on the screen will alter to a further scene. The player will continue his putts in such way as described above. When, finally, the ball enters into the hole, the image on the screen will continue to depict this final scene without changing. In this final stage of depiction, the indication on the upper right portion of the screen gives the total number of putts required by the player till the ball entered into the hole. Thereafter, the player may make one depression of the putting course setting button 6 which is provided on the side of the simulating device 1. Whereupon, the image on the screen will provide a view taken from the starting position of a new, i.e. a second, putting course toward the flag on the green. Also, the putting course number, which is indicated on the upper left portion of the screen will change to "②". However, the indication on the upper right portion of the screen will be "1st", and the indication just below it will be the numeral showing the distance to the flag. Thus, the player is now able to practice putts from the starting position of the second putting course. In this way, the player may depress the putting course setting button 6 twice, thrice, four times . . . In accordance with these depressions of the button, the image on the screen will change, in accordance with successive depressions of the button, to images as viewed from the starting position of the third, fourth, fifth, . . . putting course toward the flag on the green. Concurrently therewith, the indication on the upper left portion of the screen will be "③, ④, ⑤, . . . ". In this apparatus of the instant embodiment, arrangement is provided so that the player is able to select ten (10) putting courses, one at a time. In the apparatus of this instant embodiment, arrangement is made so that ten (10) putting courses are incorporated. Accordingly, the player is able to practice putts on ten different putting courses beginning at the aforementioned starting position toward the flag on the green. In addition thereto, the player is able to arbitrarily select any one of these ten putting courses by simply depressing the putting course setting button 6. It should be understood here that the reset button 5 is intended to restore the image on the screen back to the first "1st" strike of putt at the initial start. Therefore, when the player depresses this reset button 5 during the course of practice or after entry of the ball in the cup, the image on the screen will become retrograded back to the image of that particular scene that the player has till then been standing on the last starting position, i.e. meaning that the number depicted on the upper left portion of the screen remains to be the same.

Next, description will be made of the arrangement of the simulating device 1 stated above, by referring to FIG. 2. In this Figure, large arrows formed with double lines indicate the channels through which data are transmitted, whereas a single-line arrows represent the channels through which either a control signal or an address signal is transmitted. Also, the simulating device 1 is arranged so that the processing of these data is performed by digital technique.

Figure 2:
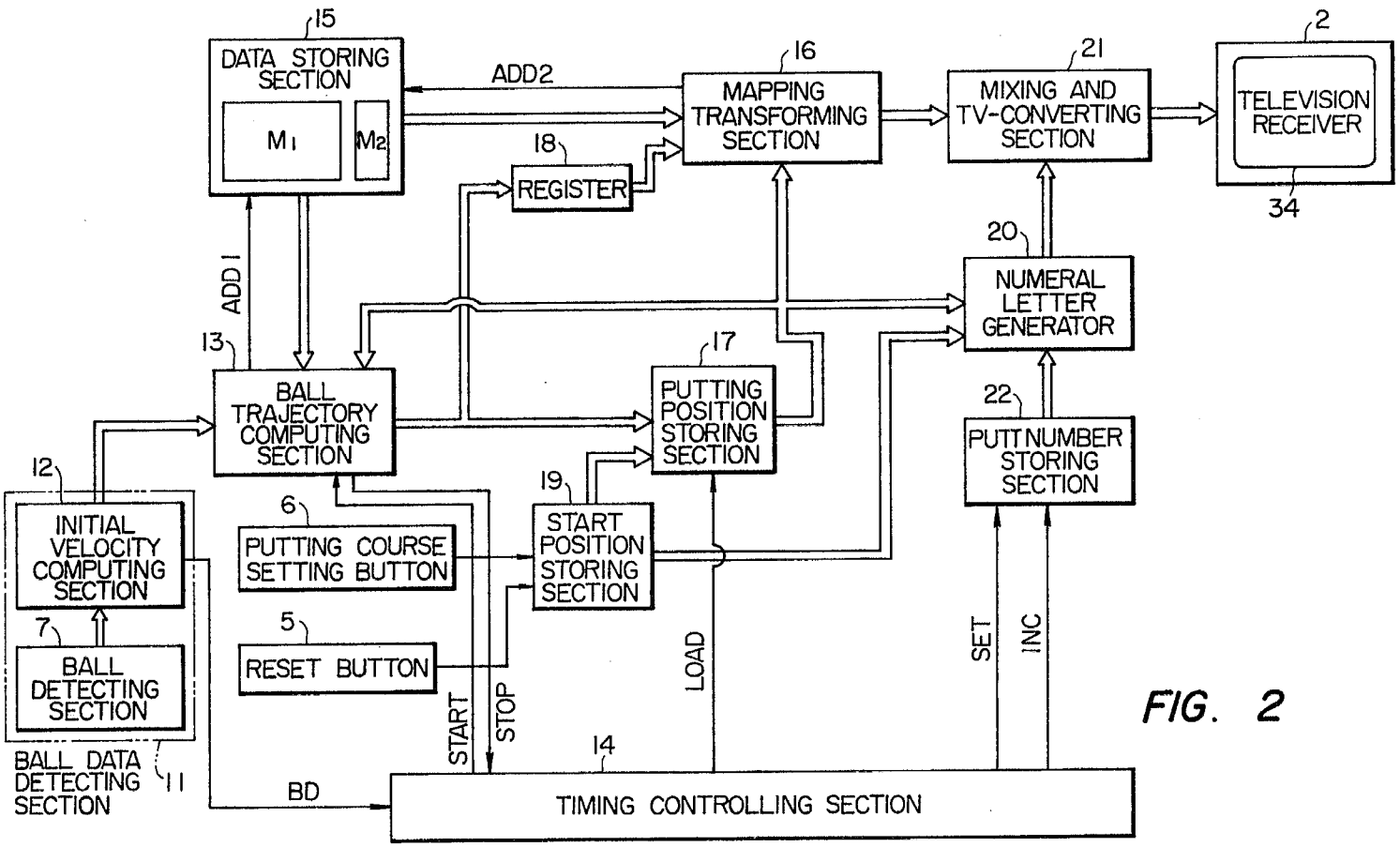
FIG. 2 is a block diagram showing an embodiment of a simulating device which is an essential part of the present invention.

In FIG. 2, a ball data detecting section 11 is assigned to detect the velocity vector, i.e. speed and direction, of the ball which hits the ball detecting section 7. This ball data detecting section 11 is comprised of the ball detecting section 7 and an initial velocity computing section 12. The information of the velocity data, i.e. the data of the velocity vector, and a ball detecting signal BD are supplied to a ball trajectory computing section 13 and a timing controlling section 14, respectively. On the other hand, a data storing section 15 is a memory circuit in which the data concerning the various heights of the curved surface of the green and also the data concerning the external configuration of the ball are stored in advance. The data concerning the curved surface of the green are supplied to the ball trajectory computing section 13, as those of the curved surface data are designated by an address signal $ADD_1$. On the other hand, these curved surface data and data of the external configuration of the ball are address-designated by an address signal $ADD_2$, and they are supplied to a mapping transforming section 16. The ball trajectory computing section 13 performs computation of the trajectory of the ball rolling on the curved surface of the green based on the data concerning the velocity of the ball delivered form the ball data detecting section 11, the data concerning the curved surface delivered from the data storing section 15 and the data concerning the putting position delivered from a putting position storing section 17. This ball trajectory computing section 13 starts computation upon its receipt of a start signal STA from the timing controlling section 14. The respective results of computation, i.e. the data concerning the trajectory of the rolling ball, are successively supplied to a register 18 and said putting position storing section 17. Also, in case the ball comes to a halt, a stop signal STO is supplied to the timing controlling section 14. The putting position storing section 17 is a memory circuit for storing sequentially the successive positions of rest of the ball, i.e. the successive putting positions of the player. This putting position storing section 17 is supplied with data form either the ball trajectory computing section 13 or a start position storing section 19, and its output, i.e. data concerning the putting position, which is supplied to the ball trajectory computing section 13, the mapping transforming section 16 and a numeral-letter generator 20. More particularly, in case either the reset button 5 or the putting course setting button 6 is depressed, this putting position storing section 17 stores the data concerning the starting position which is supplied from the start position storing section 19. Also, in case a stop signal STO is outputted from the ball trajectory computing section 13 to the timing controlling section 14, said putting position storing section 17 stores the data concerning the ball trajectory supplied from the ball trajectory computing section 13 by a load signal LOAD delivered from the timing controlling section 14, i.e. in this case, the trajectory data are those concerning the position at which the ball has come to a halt. The start position storing section 19 is a memory circuit in which the respective starting positions of the ten (10) different putting courses are memorized in advance. As stated above, when the reset button 5 is depressed, the data concerning the starting position on that particular putting course on which the player has till then been practicing putting are supplied to the putting position storing section 17. Also, when the putting course setting button 6 is depressed once, twice, . . . , the data concerning the starting position of the next putting course of that putting course on which the player has been practicing his putt till then, the second next putting course, and so on, are supplied to the putting position storing section 17 in such sequential fashion. Concurrently therewith, the number of the putting course corresponding to the aforesaid start position data is supplied to the numeral-letter henerator 20 in similar sequential fashion. The mapping transforming section 16 alters the image data to another image data of the curved surface of the green as viewed from each latest putting position of the player based on the data concerning the putt position delivered from the putt position storing section and the data concerning the curved surface delivered from a data storing section 15, and also alters the trajectory of the ball rolling on the curved surface of the green to a two-dimensional image data based on the trajectory data supplied from the register 18 and the data concerning the external configuration of the ball supplied from the data storing section 15, the details of which will be described later. These image data are supplied to a mixing and TV-converting section 21. A putt number storing section 22 is a counter for memorizing the times of putts made. When the reset button 5 or the putting course setting button 6 is depressed, and when, accordingly, a setting signal SET is outputted from the timing controlling section 14, the content of this counter is set to "1" (note: the content is also set to "1" when the apparatus is connected to the power supply). Also, when a stop signal STO is outputted from the ball trajectory computing section and when, accordingly, an increment signal INC is outputted from the timing controlling section, the content of the counter advances by "1". The output, i.e. the data concerning the times of putts made, of the putt number storing section 22 is supplied to the numeral-letter generator 20. This numeral-letter generator 20 is an ordinary character generator. This generator 20 converts the respective data supplied from the start position storing section 19 and from the putt number storing section 22 to an image pattern (image data), and supplies this image pattern to the mixing and TV-converting section 21. This mixing and TV-converting section 21 operates so that it mixes, by its OR circuit, the respective image data delivered from the mapping transforming section 16 and from the numeral-letter generator 20, and converts the mixed data to a video signal to be displayed on the screen of the television receiver 2. This converted video signal is supplied to the television receiver 2, and is displayed as a visible image on the screen.

Description will hereunder be made in further detail of the essential portions of the above-stated arrangement of the apparatus. I. Ball data detecting section 11

Figure 3:
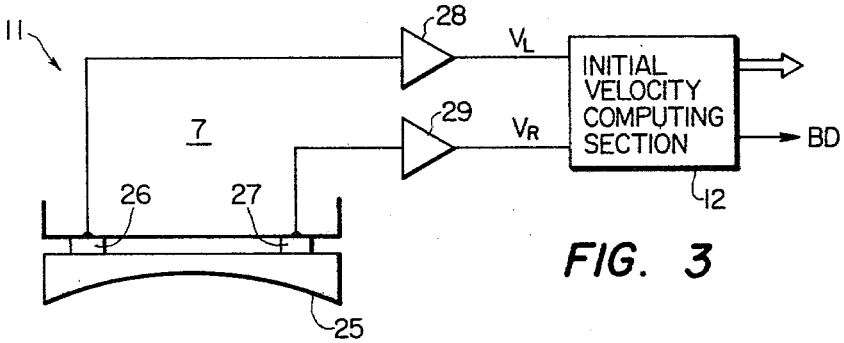
FIG. 3 is a block diagram showing an arrangement of the ball detection section in the simulating device of FIG. 2.

As shown in FIG. 3, the ball detecting section 7 is comprised of a collision plate 25 having a curved face, two pressure-sensitive elements 26 and 27 such as piezoelectric elements or strain gauges, and two amplifiers 28 and 29 to which are supplied the respective outputs of these pressure-sensitive elements. And, the outputs of these amplifiers 28 and 29 are arranged to be supplied to the initial velocity computing section 12. This initial velocity computing section 12 is assigned to make computation, on the basis of the outputs of said amplifiers 28 and 29, of both the speed and the direction, i.e. velocity vector, of the ball at the moment that it collides against the collision plate 25. Let us here assume that the output voltage of the amplifier 28 is represented by $V_L$, and that the output voltage of the amplifier 29 is represented by $V_R$. Then, the initial velocity vector $\vec{v_o}$ is such that its magnitude $|\vec{v_o}|$ is obtained by the following formula:

$$|\vec{v_o}| = \alpha(V_R + V_L) \quad (1),$$

and the direction of the ball is obtained from the following formula:

$$\arg \vec{v_o} = \beta\left(\frac{V_R - V_L}{V_R + V_L}\right). \quad (2)$$

It should be noted here that, in the above formulas (1) and (2), $\alpha$ and $\beta$ represent constants, respectively. More particularly, the initial velocity computing section 12 first performs the computation of the above-mentioned formulas (1) and (2), and then supplies the result of computation, i.e. data concerning velocity, to the ball trajectory computing section 13, as an initial value of the trajectory computation, and concurrently therewith, it outputs a ball detection signal BD to the timing controlling circuit 14.

II. Data storing section 15

Figure 4A:
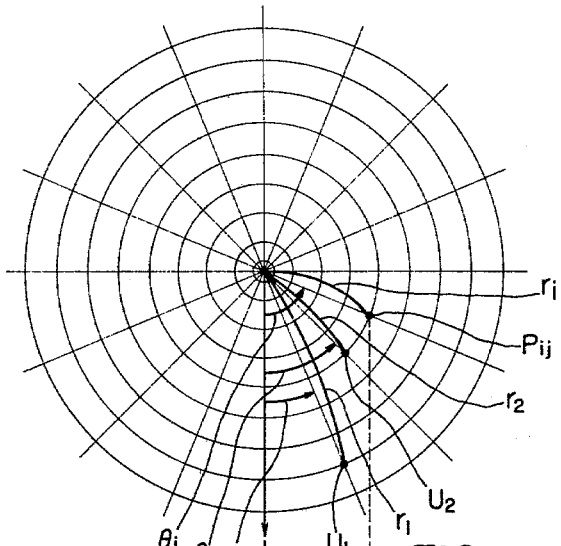
Figure 4B:
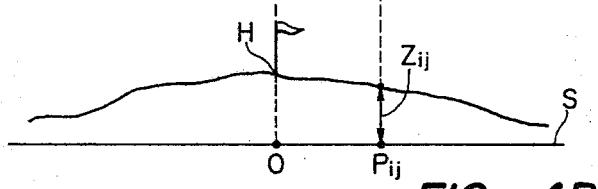

This data storing section 15 is comprised of, for example, a non-volatile semiconductor ROM (Read Only Memory), and it is formed with an area $M_1$ which stores the data concerning the distribution of the various heights of the curved surface of the green and an area $M_2$ which stores the data concerning the external configuration of the ball. It is to be noted that, as shown in FIGS. 4A and 4B, a number of points $P_{ij}$ which are set on a reference horizontal plane S are expressed by polar coordinates using, as the original point, the point O on said reference horizontal plane S just below the hole H, i.e.:

$$P_{ij}=(r_i, \theta_j) \quad (3).$$

Said area $M_1$ stores the information of the various height $Z_{ij}$ of those points on the curved surface of the green just above these points $P_{ij}$ from the reference horizontal plane S, at sites within this area $M_1$ for which said i and j are used as addresses. Also, the area $M_2$ stores the polar coordinates representing the external configuration of the ball and using the center of the ball as the point of origin. It should be understood here that the data concerning the curved surface of the green may be defined by coordinates x-y centering around point 0. However, the indication by polar coordinates has the advantages that there are obtained more dense data in the vicinity of the hole H, and that such indication is convenient for subsequent computations. For these reasons, polar coordinate indication is employed in this embodiment.

III. Putt position storing section 17

The putting position storing section 17 stores, in case the putt is the first one, i.e. in case of "1st", the start position data based on the polar coordinate indication supplied from the start position storing section 19. When, however, the player has terminated the first putt, and when accordingly the ball comes to a halt on the television screen, said stored memory is switched to the data based on the polar coordinate indication representing the position of the halt of the ball. Let us here assume that the position of the first putt is designated by $U_1(r_1, \theta_1)$, and the position of the second putt as $U_2(r_2, \theta_2)$ . . . Then, this putt position storing section 17 stores $(r_1, \theta_1)$ at the time of the first putt. When, however, the first putt is terminated and when, accordingly, the ball comes to a halt at another putt position $U_2(r_2, \theta_2)$, the memory is rewritten to $(r_2, \theta_2)$. This process is repeated in succession until the ball enters into the cup at the target. It should be understood here that the point of origin of said polar coordinates is the point 0 in FIG. 4B.

IV. Ball trajectory computing section 13

Description will hereunder be made of the principle of the computation of the ball trajectory. It should be understood here that in the following explanation, the slip friction of the ball is considered to be practically negligibly small in its influence, so that this slip friction of the ball is not taken into account here.

Figure 5:
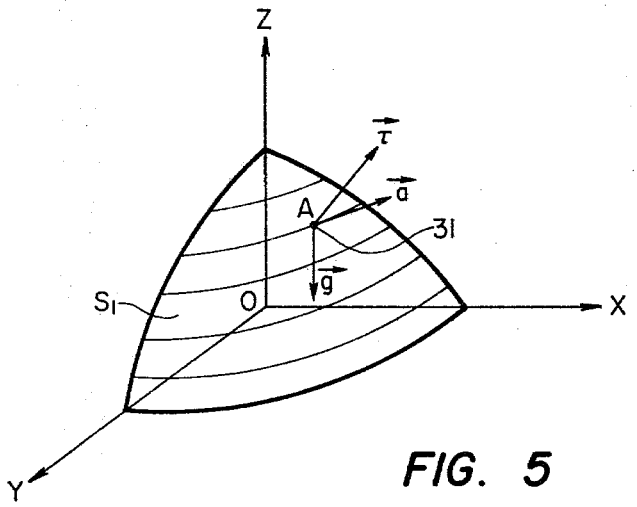

IV-1 . Consideration will first be made of the instance where the resistance by the turf or grass is nil. In case, as shown in FIG. 5, a ball 31 which rolls by its own gravity on the curved surface $S_1$ having indications of the contour lines is passing the point A at time t, the normal line vector of the curved surface $S_1$ at point A is designated by $\vec{\tau}$, the angular velocity vector of the rotation of the ball 31 by $\vec{\omega}$, the gravity acceleration vector by $\vec{g}$, the mass of the ball by M, the radius of the ball by R, and the moment of inertia of rotation about the center of the gravity, i.e. equals to the center, of the ball by $I_G$. Then, the movement formula indicating the angular acceleration of the ball 31 is given, in general, by the formula:

$$\frac{d\omega}{dt} = \frac{MR}{I_G + MR^2}(\vec{\tau} \times \vec{g}). \quad (4)$$

This formula (4) is one in the rectangular coordinate system wherein the axis Z is taken in the anti-gravity direction as shown in FIG. 5. Accordingly, the coordinates of point A is A(X, Y, Z). In this formula (4), the vector:

$$\vec{a}=\vec{\tau}\times\vec{g} \quad (5)$$

is such that its direction is in agreement with the direction of the contour lines and its magnitude indicates the degree of the intensive downward rolling of the ball. More particularly, the above-mentioned formula (4) shows that the ball 31 exerts its movement in such way that its axis of spin approaches the direction of contour line, i.e. that the ball rolls downwardly following the directions of the steepest inclination of the curved surface of the green.

IV-2.

Next, consideration will be made of the resistance exerted by the grass. First of all, let us take up the instance wherein the ball makes a rectilinear movement on a horizontal ground covered by grass. Herein, the work done by the ball against the grass per unit distance, i.e. the amount of energy which the ball loses per unit distance, is assumed to be designated by B. Then, from the law of energy conservation, there can be established the following formula:

$$\tfrac{1}{2}(I_G + MR^2)\omega^2 + B\int R\omega dt = \tfrac{1}{2}(I_G + MR^2)\omega_0^2 \quad (6)$$

wherein: $\omega_0$ represents the initial angular velocity of the ball; and the other symbols are as mentioned above.

By differentiating the left and the right terms of the formula (6) and reorganizing them, there can be obtained the following formula concerning angular acceleration. That is, from this formula:

$$\frac{d\omega}{dt} = \frac{-BR}{I_G + MR^2}, \quad (7)$$

it will be seen that the ball is reducing its speed at a constant rate under the afore-mentioned condition.

Figure 6:
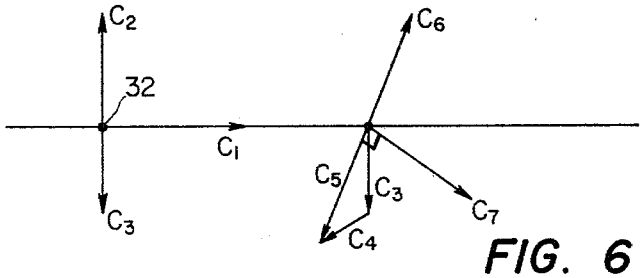
FIGS. 5 and 6 are diagrams for explaining the operation of the ball-trajectory computing section in the device in FIG. 2.

The above-mentioned work per unit distance, B, represents a value corresponding to the resistance of the grass, i.e. corresponding to the firmness of the turf. Next, consideration will be made of the displacement of the path taken by the ball due to the direction of the leaves of the grass. In FIG. 6, let us assume that the ball 32 positioned at point C is making a rectilinear movement while rolling in the direction of the arrow $C_1$. Then, the angular velocity vector $\vec{\omega}$ of the axis of spin of the ball during this rotating movement is expressed by the arrow $C_2$. Also, the vector $\vec{B}$ of the power (work done per unit distance) B participates in terms of resistance component, so that this vector is expressed by the arrow $C_3$ which is opposite to the arrow $C_1$. That is, $$\vec{B} = -\frac{\vec{\omega}}{|\vec{\omega}|} B. \tag{8}$$

Here, by assuming that the vector of the direction of the leaves of the grass as being $\vec{b}$, this vector $\vec{b}$ may be expressed by, for example, the arrow $C_4$. Accordingly, the synthetic vector of the power vector $\vec{B}$ and the grass direction vector $\vec{b}$ will become like the arrow $C_5$. Also, the angular velocity vector $\vec{\omega}$ of the ball 32 in case the grass direction vector $\vec{b}$ also is taken into account will be expressed by the arrow $C_6$, which, when expressed by a vector formula, will become as mentioned below, in which the formula (7) is modified, as:

$$\frac{d\vec{\omega}}{dt} = \frac{-(\vec{B} + \vec{b})R}{I_G + MR^2}. \tag{9}$$

That is, the ball 32 will take its path of rolling which is displaced in the direction of the arrow $C_7$ due to the grass direction vector $\vec{b}$ shown by the arrow $C_4$. It should be understood that $|\vec{b}|$ represents the firmness of the direction of the leaves of the grass, and arg $\vec{b}$ represents the direction of the leaves of the grass. More particularly, in case the direction of the leaves of the grass is more or less inclined in the direction toward the goal, the vector $\vec{b}$ faces toward the vector $\vec{\omega}$. In contrast thereto, in case the direction of the leaves of the grass is inclined more or less toward the player, the vector $\vec{b}$ will be in a direction opposite to that of the vector $\vec{\omega}$.

IV-3.

From the results obtained in accordance with IV-1 and IV-2, the movement formula of the ball rolling on the curved surface of the green will be sought as follows from the above-mentioned formulas (4), (8), and (9):

$$(I_G + MR^2)\frac{d\vec{\omega}}{dt} = MR(\vec{\tau} \times \vec{g}) - \left(\frac{\vec{\omega}}{|\vec{\omega}|} B + \vec{b}\right) R. \tag{10}$$

Next, description will be made of the instance wherein the trajectory of the ball is computed by using the above-mentioned formula (10). Let us here assume that the grass direction vector $\vec{b}$ and the power B are set preliminarily as constants. The power B may not necessarily be a constant. It should be understood, however, that by using this power B to serve as a constant, it is possible to sufficiently attain the object of the planned simulation. It should be understood here also that the effect of the grass direction will vary depending on the direction of rolling of the ball, so that even in case the grass direction vector $\vec{b}$ is a constant, difference from actual play will not become substantially large. Here, let us assume that the interval of the sampling times for computing the trajectory of the ball is designated by $\Delta t$.

Then, the formula (10) can be expressed, approximately, by the following differential equation:

$$(I_G + MR^2)\frac{(\vec{\omega}_{n+1} - \vec{\omega}_n)}{\Delta t} = MR(\vec{\tau}_n \times \vec{g}) - \left(\frac{\vec{\omega}_n}{|\vec{\omega}_n|} B + \vec{b}\right) R \tag{11}$$

wherein: $\vec{\omega}_n$ and $\vec{\tau}_n$ represent the angular velocity vector of the ball, and the normal line vector of the slope of the green at which the ball is positioned, respectively, at n-th sampling time (namely, at the end of passage of time $n \cdot \Delta t$ after the ball is detected by the ball data detecting section 11); and $\vec{\omega}_{n+1}$ represents the angular velocity vector of the ball at the (n+1)-th sampling time.

The $\vec{\tau}_n$ in the above-mentioned formula (11) can be sought in the manner as follows:

$$\vec{\tau}_n = (\tau_x, \tau_y, \tau_z) \tag{12}$$

$$\text{wherein: } \left.\begin{aligned} \tau_x &= \sin\left(\tan^{-1}\frac{\delta z}{\delta x}\right) \\ \tau_y &= \sin\left(\tan^{-1}\frac{\partial z}{\delta y}\right) \\ \tau_z &= \sqrt{1 - \tau_x^2 - \tau_y^2} \end{aligned}\right\}.$$

Furthermore, this formula (12) is expressed approximately by the following formula after dismembering and sorting:

$$\vec{\tau}_n = (\tau_{xn}, \tau_{yn}, \tau_{zn}) \tag{13}$$

$$\text{wherein: } \left.\begin{aligned} \tau_{xn} &= \frac{\Delta z}{\Delta x} = \frac{z_{n+1} - z_n}{x_{n+1} - x_n} \\ \tau_{yn} &= \frac{\Delta z}{\Delta y} = \frac{z_{n+1} - z_n}{y_{n+1} - y_n} \\ \tau_{zn} &= \sqrt{1 - \tau_{xn}^2 - \tau_{yn}^2} \end{aligned}\right\}.$$

Therefore, by applying the initial velocity data of the ball delivered from the ball data detecting section 11 and the curved surface data of the green supplied from the data storing section 15 to the above-mentioned formulas (11) and (13), it is possible to seek the successively changing trajectory of the ball sequentially with a sampling interval of $\Delta t$: And, at the time $\vec{\omega}=0$, i.e. at the time that the ball has come to a halt, the detecting circuit not shown which is provided within the ball trajectory computing section 13 detects this halt of the ball, and it outputs a stop signal STO to the timing controlling section 14.

What should be noted of the explanation made above is that the computation of the above-mentioned formulas (11) and (13) is conducted with respect to a rectangular coordinate system as contrasted by the curved surface data of the green stored in the data storing section which is memorized therein on the basis of polar coordinate system. More particularly, in the above-mentioned ball trajectory computing section 13 is provided a computing section intended for the transformation of coordinates, which operates in such manner that the values (X, Y) of the rectangular coordinate system are first transformed to values (r, $\theta$) of the polar coordinate system by the following formulas:

$$\left.\begin{aligned} X &= r\sin(\theta-\theta_1) \\ Y &= r\cos(\theta-\theta_1) \end{aligned}\right\}, \quad \text{(F)}$$

wherein: $\theta_1$ represents the angle defined by an axis Y connecting the point at which the player is standing and the hole in the green, and the reference axis of the polar coordinate indication of the green, and thereafter it outputs an address signal $ADD_1$, to thereby obtain the curved surface data $Z_{ij}$ of the green corresponding to the above-mentioned polar coordinate values (r, $\theta$).

V. Mapping transforming section 16

Figures 7A, 7B:
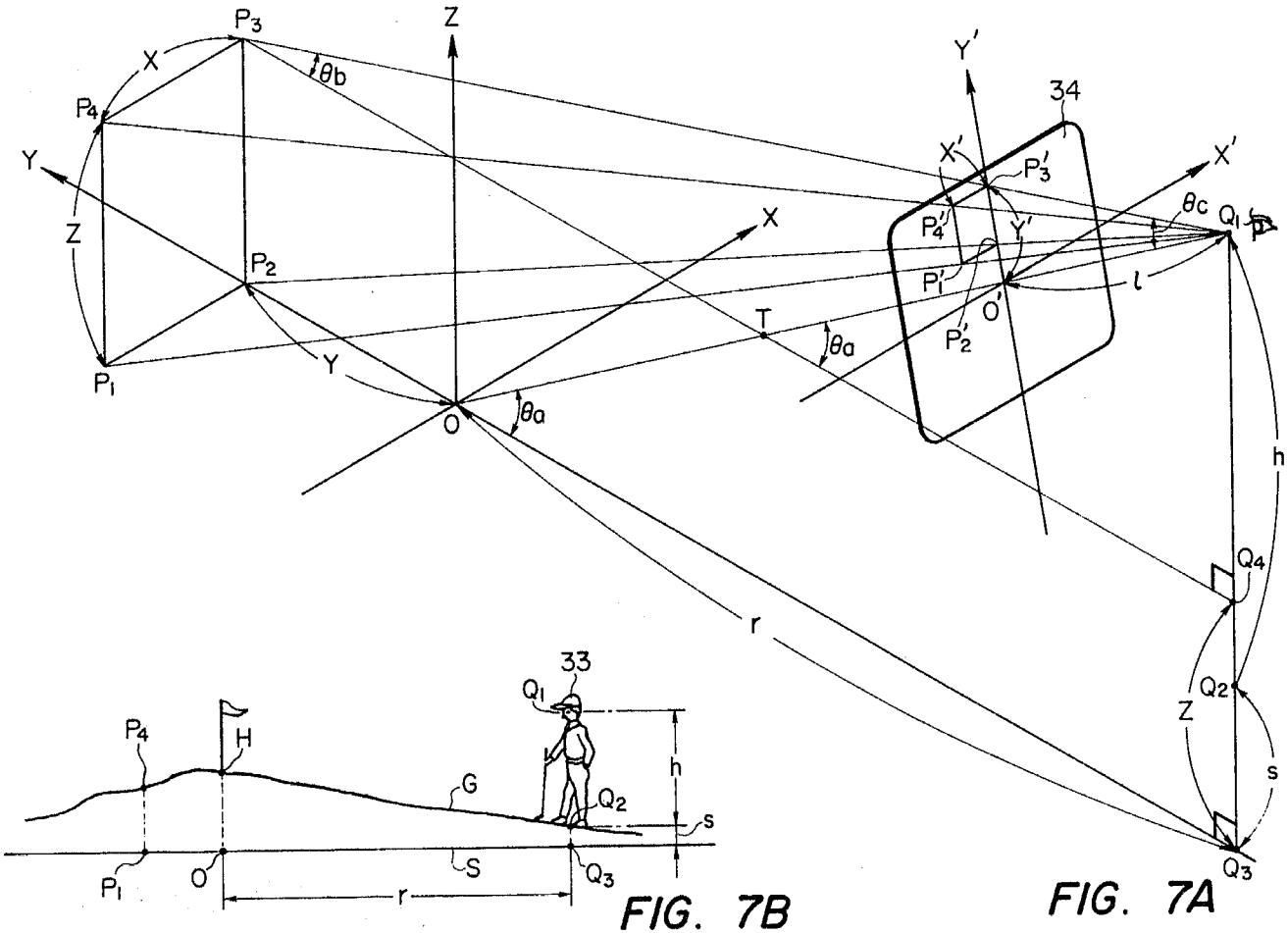

FIGS. 7A and 7B are diagrams for explaining at which point on the television screen a point on the curved surface of the actual green should be displayed, i.e. diagrams for explaining the principle of the mapping transformation such that three dimensional curved surface of the green is converted to two dimensional data. In these Figures, point O represents a point on a horizontal plane S just below the hole H as shown in FIG. 7B. It should be understood here that this point O is identical with the point O shown in FIGS. 4B and 5. Point $Q_1$ represents the position of the eyes of the player 33, and point $Q_2$ represents the point on the curved surface G of the green just below the point $Q_1$. Therefore, a height indicated by:

$$\overline{Q_1Q_2}=h \quad (14)$$

represents the height of the eyes of the player from the curved surface G of the green, i.e. the effective height of the player. Point $Q_3$ is a point on the horizontal plane S just below the point $Q_1$. The rectilinear line connecting this point $Q_3$ and the aforesaid point O is hereby designated as an axis Y of the rectangular coordinate system for showing the distribution of the heights of the curved surface G of the green. A rectilinear line on the horizontal plane S and passing through the point O and intersecting this axis Y ar right angle is designated as an axis X. A rectilinear line passing through the point O and intersecting the horizontal plane S at right angle is designated as an axis Z. These coordinate axes are identical with those coordinate axis shown in FIG. 5. Reference numeral 34 in FIG. 7A represents a television screen. The point of intersection of the rectilinear line $Q_1O$ and this television screen 34 is designated as point O'. A rectilinear line passing through this point O' and positioned on the television screen 34 parallel with said axis X is designated as an axis X' of the rectangular coordinate axes for indicating a point on the television screen. A rectilinear line passing through the point O' and located on the television screen 34 intersecting the axis X' at right angle is designated as an axis Y'. The point $P_1$ is an arbitrary point on the horizontal plane S. Point $P_4$ is a point on the curved surface G of the green just above the point $P_1$. Point $P_2$ represents a point of intersection of a rectilinear line drawn on the horizontal plane S from point $P_1$ in parallel with the axis X, and the axis Y. Point $P_3$ is a point of intersection of a rectilinear line drawn vertically to the horizontal plane S from point $P_2$ and a rectilinear line drawn in parallel with the rectilinear line $P_1P_2$ from point $P_4$. Point $P_1'$ represents a point of intersection of the rectilinear line $Q_1P_1$ and the television screen 34. Point $P_2'$ represents a point of intersection of the rectilinear line $Q_1P_2$ and the television screen 34. Point $P_3'$ represents a point of intersection of the rectilinear line $Q_1P_3$ and the television screen 34. Point $P_4'$ represents a point of intersection of the rectilinear line $Q_1P_4$ and the television screen 34. Point $Q_4$ represents a point of intersection of a rectilinear line drawn in parallel with the axis Y from the point $P_3$ and the rectilinear line $Q_1P_3$. Also, the respective lengths of the segment of line $Q_1O'$, the segment of line $Q_2Q_3$ and the segment of line $OQ_3$ are designated here as:

$$\overline{Q_1O'}=l \quad (15)$$

$$\overline{Q_2Q_3}=s \quad (16)$$

$$\overline{OQ_3}=r \quad (17).$$

Hereunder will be sought transformation formulas of the coordinates (X, Y, Z) of point $P_4$ and the coordinates (X', Y') of point $P_4'$. Firstly, assuming that $\angle P_3'Q_1O'=\theta_c$, $$Y'=l\tan\theta_c \quad (18).$$

Here, if the point of intersection of the rectilinear line $Q_1O$ and the rectilinear line $P_3Q_4$ is designated as T, and if $\angle Q_1TQ_4=\theta_a$ and $\angle Q_1P_3Q_4=\theta_b$, $$\theta_c=\theta_a-\theta_b \quad (19),$$

and also, $\angle Q_1OQ_3=\angle Q_1TQ_4=\theta_a$. The above-mentioned $\theta_a$ and $\theta_b$ are obtained from the following formulas:

$$\theta_a = \tan^{-1}\frac{h+s}{r} \quad (20)$$

$$\theta_b = \tan^{-1}\frac{h+s-Z}{Y+r}. \quad (21)$$

Accordingly, by substituting these formulas (20) and (21) to the above-mentioned formula (19), and further by substituting this formula (19) to the formula (18), there can be obtained the following relationship:

$$Y' = l\tan(\theta_a-\theta_c). \quad (22)$$

$$= l\tan\left(\tan^{-1}\frac{h+s}{r}-\tan^{-1}\frac{h+s-Z}{Y+r}\right)$$

On the other hand, from the similitude relationship between the triangle $Q_1P_3P_4$ and the triangle $Q_1P_3'P_4'$, there can be obtained the following relationship:

$$\frac{X'}{X}=\frac{\overline{Q_1P_3'}}{\overline{Q_1P_3}}. \quad (23)$$

Here, $$\overline{Q_1P_3'}=\sqrt{l^2+(Y')^2}, \quad (24)$$

and

-continued $$\overline{Q_1P_3} = \sqrt{(Y + r)^2 + (h + s - Z)^2} \quad (25)$$

Accordingly, by substituting these formulas (24) and (25) to the formula (23), there can be obtained the following relationship:

$$X' = X\frac{\sqrt{\ell^2 + (Y')^2}}{\sqrt{(Y + r)^2 + (h + s - Z)^2}}. \quad (26)$$

That is, this formula (26) and the afore-mentioned formula (22) serve as the formulas for transformation of coordinate system for point $P_4(X, Y, Z)$ and point $P_4'(X', Y')$.

Next, description will be made with respect to the method of displaying on the television screen the curved surface G of the green by utilizing the above-mentioned formulas of transformation of coordinate system. As such method, there can be considered various methods including a display by, for example, using contour lines; or drawing, on the curved surface G of the green, meshlike imaginary lines and displaying these imaginary lines on the television screen. In this embodiment, however, there is employed a display by the method of indicating contour lines.

Let us here assume that the putt position data which are stored in the putt position storing section 17 are designated as $(r_m, \theta_n)$. By supplying, as an address $ADD_1$, these $r_m$ and $\theta_n$ to the data storing section 15, it is possible to obtain from the data storing section 15 the height of the putt position on the curved surface G of the green from the horizontal plane S, i.e. the height S in FIG. 7A. Here, it is assumed that the height h of the eyes of the player 33, and the distance from the position of these eyes to the point O' on the television screen are preliminarily set. Also, the length r in FIG. 7A is equal to the above-mentioned $r_m$. Now, the coordinates (X, Y, Z) of points on the curved surface G of the green corresponding to the respective points on the scanning lines on the television screen 34 are sought from the aforementioned formulas (22) and (26) and from the curved surface data of the green which are memorized in the data storing section 15. Then, from among these heights, namely, the values Z, of these respective points thus sought leading from the horizontal plane S, those points which are contained in a preliminarily set interval or band defined by the contour lines are extracted. Then, on the basis of the coordinates (X', Y') on the television screen of these extracted points, there are formed a train of data (display image data) serving as a source of a video signal. More particularly, let us assume that the reference interval corresponding to the intervals between the respective predetermined contour lines is designated as $h_T$, and let us preliminarily determine the value of $\epsilon$ which is $h_T >> \epsilon$, and there is extracted a point (X, Y, Z) on the curved surface of the green having a height Z satisfying the following formula:

$$Nh_T \leqq Z \leqq Nh_T + \epsilon \quad (27),$$

wherein: N represents an integer, whereby the aforesaid train of data is produced. The reason for providing an interval $\epsilon$ for the contour lines is because, if only those points (X, Y, Z) corresponding to the reference interval $h_T$ are extracted, the number of points which are extracted becomes scarce, and accordingly, it becomes impossible to clearly display the contour lines on the television screen, and because of this reason, it is intended to arrange so that points lying within the interval $\epsilon$ can be extracted. It should be understood here that, in the above-stated description, points (X, Y, Z) on the curved surface of the green are expressed by the rectangular coordinate system. It will be needless to say that, in case addressing is made to the data storing section 15, such rectangular coordinate system has to be transformed first to polar coordinate system (r, $\theta$) and then addressing is made, as explained previously.

Next, description will be made of the instance wherein the ball trajectory is displayed on the television screen 34. The ball trajectory data which are supplied to the register 18 in FIG. 2 are in the form of the values of coordinates (X, Y, Z) shown in FIG. 7A (refer to item IV above). Accordingly, those ball trajectory data which are stored successively in the register 18 can be transformed, in succession, to points (X', Y') on the television screen 34, by utilizing the above-mentioned formulas (22) and (26). The data concerning the external configuration of the ball can be obtained by addressing the area $M_2$ of the data storing section 15. The mapping on the television screen 34 in case the ball is positioned on a point contained in the trajectory data of the register 18 can be obtained by the application of the aforesaid formulas (22) and (26). And, by carrying out the foregoing computations with real time, it becomes possible to make displays of the ball trajectory on the television screen 34 while progressively varying the size of the ball rolling closer to the target hole. In such case, from the data of coordinates (X', Y') on the television screen 34 of the ball trajectory which are obtained through the aforesaid computations, there is formed a train of data for video signal, and there is formed a fresh train of data (display image data) for video signal by mixing the first-mentioned train of data and the train of data of contour lines indicating the curved surface G of the green.

VI. Timing controlling section 14

The timing controlling section 14 has the following functions. First of all, at the time the apparatus is connected to a power supply, it outputs a set signal SET to the putt number storing section 22, to set to "1" the count of the counter provided within this putt number storing section 22. In case a ball detection signal BD is supplied from the initial velocity computing section 12, it outputs a start signal STA to the ball trajectory computing section 13. In case a stop signal STO is delivered from the ball trajectory computing section 13, it outputs a load signal LOAD to the putt position storing section 17, and at the same time it outputs an increment signal INC to the putt number storing section 22 to cause one increment of the number of putts made. In case either the reset button 5 or the putting course setting button 6 is depressed, it outputs a set signal SET to the putt number storing section 22.

What is required to be noted in the above-stated explanation of the essential parts of the apparatus is that the (X-Y) axes of coordinates vary depending on the putting position, as contrasted by the axes of coordinates (r-$\theta$) which always remain constant.

With the foregoing statement, the description of the respective parts of the simulating device 1 shown in FIG. 2 ends. Description will next be made of the operation of the simulating device 1.

Upon connection of the simulating device 1 to the power supply, the putt number storing section 22 is set to "1", and concurrently therewith a start position data for the putting course No. ① is supplied from the start position storing section 19 to the putt position storing section 17. This start position data is delivered from the putt position storing section 17 to the mapping transforming section 16. This mapping transforming section forms a display image data (a train of data) so as to indicate the curved surface of the green on the television screen 34 by contour lines on the basis of the start position data mentioned above and also of the data concerning the curved surface of the green memorized in the data storing section 15. In such instance, the above-said display image data is one that the curved surface of the green is viewed from the start position which is determined by said start position data. The above-mentioned display image data is supplied to the mixing and TV-converting section 21, jointly with the display image data from the numerical figure generator 20, i.e. putting course No. "①", putt No. "1st" and distance "m", and is transformed thereat into a video signal to be displayed on the television screen 34. It should be understood here that the above-mentioned "m" is the distance from the putting position up to the target. This distance is computed in the distance computing section not shown, based on the respective data stored in the putt position storing section 17 and the data storing section 15, and it is supplied to the numerical figure and letter generator 20.

Next, the player places a ball on the designated position, i.e. at the position of mark X indicated at 9 in FIG. 1, and performs a first putt toward the target, i.e. the hole, depicted on the television screen. Upon the collision of this ball thus struck, against the collision plate 25 of the ball detecting section 7, this ball detecting section 7 detects this fact. On the basis of the result thus detected, the initial velocity computing section 12 computes the velocity vector (velocity data) and delivers the information to the ball trajectory computing section 13, and at the same time, it delivers a ball detection signal BD to the timing controlling section 14. Upon receipt of this ball detection signal BD by the timing controlling section 14, this latter section 14 delivers a start signal STA to the ball trajectory computing section 13. This ball trajectory computing section 13, upon its receipt of said start signal STA, carries out the trajectory of the ball in succession based on said velocity data, the data concerning the curved surface of the green delivered from the data storing section 15 and the start position data delivered from the putt position storing section 17, and supplies the result of this computation (ball trajectory data) to the register 18 successively. Then, said ball trajectory data supplied to the register 18 is transformed, successively, into display image data in the mapping transforming section 16, and this data is displayed, with real time, on the television screen 34.

When the ball depicted on the television screen 34 comes to a halt, a stop signal STO is outputted from the ball trajectory computing section 13 to the timing controlling section 14. Upon receipt of this stop signal STO by the timing controlling section 14, the latter section 14 outputs a load signal LOAD to the putt position storing section 17, to have the trajectory information concerning the position at which the ball has come to a halt memorized by the putt position storing section 17, and on the other hand, it outputs an increment signal INC to the putt number storing section 22 to increment the count of the counter provided in said putt number storing section 22. After the lapse of several seconds, the image depicted on the television screen 34 changes, after the foregoing steps of processing, to an image representing a view of the curved surface G of the green taken at the second putt position, i.e. the position at which the ball has stopped, which has been freshly memorized in the putt position storing section 17, and concurrently therewith the indications on the upper right portion of the screen change to corresponding indications, so that the player is now able to make a second putt. As stated above, the image depicted on the television screen 34 changes, in succession, in accordance with the progress of putting by the player. Thus, the player is able to practice putting in a state close to the putting done on an actual green.

The above-mentioned television receiver 2 which is used in the present invention may be an exclusively designed one, or it may be the television receiver which is ordinarily used at home in general. Also, in this embodiment, arrangement is made so that the size of the ball varies in succession as the ball moves closer to the target. It should be noted, however, that the ball may be indicated by a dot to save the provision of hardware. Further, in the instant embodiment, there are memorized, in advance, ten (10) start positions in the start position storing section 19. It should be noted, however, that, by increasing this number to, for example, 18, it becomes possible to make the practicing of putts more enjoyable. Furthermore, there can be considered various ways of effectively utilizing this apparatus such as generating the start position by a random number generator; memorizing in advance a number of curved surfaces of the green in the data storing section 15; providing arrangement to display the total score for one round (which, in this embodiment, consists of 10 holes); and a music is sounded when "hole-in-one" takes place.

It should be understood that, in case those circuits shown in FIG. 2 are constructed by individual parts, the entire arrangement will become considerably large in size, but that, if these circuits are constructed by the use of microcomputers, it becomes possible to make the entire circuitry into a compact size.

As described above, according to the present invention, there can be obtained a simulating apparatus which does not require a large space and which permits the player to practice putting under conditions close to the putting done on an actual green. More particularly, the putting simulating apparatus according to the present invention is such that the firmness of the grass, the direction of the leaves of the grass, the profiles of the surface of the green, the distance from the putting point up to the target "hole", and so on, can be set arbitrarily. Accordingly, it becomes possible to practice putting in a small room, including long putt and other kinds of putting under various different conditions of the green. In addition, a plurarity of players may perform putting at the same starting point, and these players may be able to compare their scores up to the entry into the cup, to thereby enjoy the game to a further extent.

What is claimed is:

1. A golf game practicing apparatus having a putt mat provided with a putt position, comprising:

information storing section for memorizing information concerning surface condition of a "hole"-containing green;

ball information detecting section for detecting a velocity vector of the ball struck at said putt position;

ball trajectory computing section for computing a trajectory of the ball rolling on said green, based on respective informations from said information storing section and said ball information detecting section;

converting section for converting the information concerning the surface condition of the green memorized in said information storing section to be used in depiction of an image and for converting th ball trajectory computed by said ball trajectory computing section to be used in depiction of an image; and display unit for displaying movements of the ball on the green due to said putting by a signal delivered from said converting section.

2. An apparatus according to claim 1, wherein:

said information storing section comprises means for memorizing information concerning surface configuration of the green in a three-dimensional coordinate system.

3. An apparatus according to claim 2, in which:

said information storing section comprises means for memorizing a resistance vector applied to the roll and ball by the green in a three-dimensional coordinate system, said resistance vector corresponding to a resistance exerted by grass of the green, depending on the direction of its leaves.

4. An apparatus according to claim 2 in which said information storing section further comprises means for utilizing two of said three-dimensional coordinates as address information and means for utilizing the other single-dimensional coordinate so as to be addressed by the address information, said information provided by said two-dimensional coordinates representing a point on a reference plane containing a point of origin located just below said hole and said single-dimensional coordinate representing a height from said point to the surface of the green.

5. An apparatus according to claim 1, in which:

said ball information detecting section comprises:

ball detecting section formed by a collision plate against which the ball struck by a player collides, and pressure-sensitive elements provided on said collision plate; and initial velocity computing section for computing a velocity vector of the ball by an output of said pressure-sensitive elements of said ball information detecting section.

6. An apparatus according to claim 5, in which:

said pressure-sensitive elements are comprised of two of them disposed at opposite ends of said collision plate, said initial velocity computing section providing computation by seeking a magnitude of said velocity vector by a sum of the outputs of said pressure-sensitive elements, and by seeking a direction of said velocity vector by a difference between these outputs of said pressure-sensitive elements.

7. An apparatus according to claim 5, in which:

said collision plate has a concave curved surface relative to said putt position.

8. An apparatus according to claim 5, in which:

said pressure-sensitive elements are formed with elements selected from piezoelectric elements and strain gauges, each of said elements outputting a voltage to said initial velocity computing section.

9. An apparatus according to claim 1, in which:

said ball trajectory computing section computes an angular velocity vector of the rolling ball till it comes to a halt, by successive computation at a sampling for each predetermined period of time.

10. An apparatus according to claim 9, wherein said ball trajectory computing section computes said successive computations by:

seeking a ball position at a next sampling time by the angular velocity vector of the ball already obtained at a preceding sampling time;

seeking information concerning the green configuration at the ball position at the preceding sampling time; and seeking an angular velocity vector of the ball at a next position on said green configuration by utilizing said information concerning the green configuration and by said angular velocity vector of the ball already obtained at the preceding sampling time.

11. An apparatus according to claim 1, further comprising:

putt position storing section for refreshing the content of its memory to an advanced new putt position on the green, representing a position at which the ball has ceased its movement, upon receipt of a ball-halting signal delivered from said ball trajectory computing section.

12. An apparatus according to claim 11, in which:

said putt position storing section includes means for receiving, when the apparatus is connected to a power supply, a putt starting position information delivered from a starting position storing section.

13. An apparatus according to claim 12, in which:

said information storing section has means for memorizing, in addition to the information concerning the surface condition of the green, information concerning an external configuration of the ball which is to be supplied to said converting section whereat this information concerning the external configuration of the ball is converted, by an information concerning a putt position supplied from the putt position storing section, to a configuration as viewed from a putt position corresponding to the information concerning the putt position for use in depicting an image, on the display unit.

14. An apparatus according to claim 13, in which:

said information storing section further includes means for storing said information concerning the external configuration of the ball in three-dimensional coordinates.

15. An apparatus according to claim 12, in which:

said starting position storing section comprises means for memorizing information concerning putt starting positions for a corresponding plurality of putting courses, respectively.

16. An apparatus according to claim 12, further comprising:

putting course setting means for setting a putt starting position of a desired putting course selected from among said plurality of putting courses.

17. An apparatus according to claim 12, in which:

said putt position storing section outputs information to said ball trajectory computing section as information representing a position for starting a computation of a trajectory of the ball.

18. An apparatus according to claim 12, in which:

said putt position storing section further includes means for converting the information concerning the surface configuration of the green, upon receipt of an output of said putt position storing section, to form a signal corresponding to said output for being depicted on the display unit and carrying information concerning the surface configuration as viewed from a putt position on the green.

19. An apparatus according to claim 18, in which:

said converting section comprises:

mapping transforming means for receiving information concerning surface configuration of the green in a three-dimensional coordinate system from the information storing section and for transforming said information to two-dimensional information; and converting means for receiving an output of said mapping transforming means and converting this output to a display signal.

20. An apparatus according to claim 19, in which:

said two-dimensional information transformed by the mapping transforming means is information corresponding to a surface configuration of the green as viewed from a putt position delivered from said putt position storing section.

21. An apparatus according to claim 1, further comprising:

putt number storing section for receiving an output of said ball trajectory computing section and for effecting an increment of its content of putt number for each time at which the movement of the ball has ceased.

22. An apparatus according to claim 21, in which:

said putt number storing section outputs its information to numerical-figure-and-letter generator which, in turn, delivers its output to said converting section.

23. An apparatus according to claim 22, in which:

said numerical-figure-and-letter generator is adapted to be supplied from said putt position storing section with an information concerning a distance from a putt position to the "hole".

24. An apparatus according to claim 23, in which:

said numerical-figure-and-letter generator is adapted to be supplied also with information concerning putt starting position by the starting position storing section.

25. An apparatus according to claim 1, in which:

said display unit includes means to display the surface configuration of the green by contour lines.

* * * * *